US010539926B2

(12) United States Patent
Bossart et al.

(10) Patent No.: US 10,539,926 B2
(45) Date of Patent: Jan. 21, 2020

(54) BALANCE SPRING MADE OF HEAVILY DOPED SILICON FOR A TIMEPIECE

(71) Applicant: ROLEX SA, Geneva (CH)

(72) Inventors: Richard Bossart, Attalens (CH); Olivier Hunziker, Vevey (CH)

(73) Assignee: ROLEX SA, Geneva (CH)

( * ) Notice: Subject to any disclaimer, the term of this patent is extended or adjusted under 35 U.S.C. 154(b) by 158 days.

(21) Appl. No.: 15/295,449

(22) Filed: Oct. 17, 2016

(65) Prior Publication Data

US 2017/0108831 A1 Apr. 20, 2017

(30) Foreign Application Priority Data

Oct. 19, 2015 (EP) ..... 15190441

(51) Int. Cl.
*G04B 17/22* (2006.01)
*G04B 17/06* (2006.01)

(52) U.S. Cl.
CPC ..... *G04B 17/227* (2013.01); *G04B 17/063* (2013.01); *G04B 17/066* (2013.01); *G04B 17/22* (2013.01)

(58) Field of Classification Search
CPC .. G04B 17/227; G04B 17/063; G04B 17/066; G04B 17/22; G04B 17/06
See application file for complete search history.

(56) References Cited

U.S. PATENT DOCUMENTS 5,170,242 A * 12/1992 Stevens ..... H01L 21/28518 257/617
7,077,562 B2 * 7/2006 Bourgeois ..... F16F 1/021 267/166
7,682,068 B2 * 3/2010 Bourgeois ..... G04B 17/066 368/169
8,348,497 B2 * 1/2013 Daout ..... G04B 17/20 368/175
9,620,611 B1 * 4/2017 Clifton ..... H01L 29/4966
2002/0180130 A1 12/2002 Baur et al.
2005/0281137 A1 12/2005 Bourgeois et al.
2008/0008050 A1 * 1/2008 Bourgeois ..... G04B 17/066 368/127
2011/0069591 A1 * 3/2011 Daout ..... G04B 17/20 368/175

(Continued)

FOREIGN PATENT DOCUMENTS

CH 699 780 A2 4/2010
CH 709 076 A2 6/2015

(Continued)

OTHER PUBLICATIONS

European Search Report and Written Opinion dated Mar. 31, 2016 issued in counterpart application No. EP15190441; w/ English partial translation and partial machine translation (17 pages).

*Primary Examiner* — Sean P Kayes
(74) *Attorney, Agent, or Firm* — Westerman, Hattori, Daniels & Adrian, LLP

(57) ABSTRACT

A balance spring for an oscillator of a timepiece, wherein it comprises a component part, in particular at least a coil or a portion of a coil, provided with heavily doped silicon having an ion density greater than or equal to $10^{18}$ at/cm$^3$, in order to permit the thermo-compensation of the oscillator.

20 Claims, 2 Drawing Sheets

(56) References Cited

U.S. PATENT DOCUMENTS

| | | | | |
|---|---|---|---|---|
| 2015/0346687 | A1* | 12/2015 | Damasko | G04B 17/227<br>368/175 |
| 2016/0147197 | A1* | 5/2016 | Stranczl | G04B 17/34<br>368/177 |

FOREIGN PATENT DOCUMENTS

| | | | |
|---|---|---|---|
| EP | 1 258 786 | A1 | 11/2002 |
| EP | 1 422 436 | A1 | 5/2004 |

* cited by examiner

BALANCE SPRING MADE OF HEAVILY DOPED SILICON FOR A TIMEPIECE

The invention relates to a spiral spring for an oscillator of a timepiece, as well as to an oscillator, a movement for a timepiece and a timepiece of the kind which comprise such a spiral spring. Finally, it also relates to a method for producing such a balance spring.

The regulation of mechanical watches is based on at least one mechanical oscillator, which generally comprises a flywheel, referred to as the balance, and a spring wound in the form of a spiral, referred to as the spiral spring or, more simply, the balance spring. The balance spring may be fixed at one extremity to the balance staff and at the other extremity to a fixed part of the timepiece, such as a bridge, referred to as the cock, on which the balance staff pivots. The spiral spring fitted in the movements of state-of-the-art mechanical watches is present in the form of a flexible metallic strip or a silicon strip of rectangular cross section, the major part of which is wound around itself in the form of an Archimedes' spiral. The balance spring vibrates around its position of equilibrium (or the neutral position). When the balance leaves this position, it arms the balance spring. This creates a restoring torque which acts on the balance with the aim of causing it to return to its position of equilibrium. Since it has acquired a certain velocity, and therefore kinetic energy, the balance continues to travel past its neutral position until a counter-torque of the spring stops it and obliges it to rotate in the other direction. In this way, the balance spring regulates the period of vibration of the balance.

The accuracy of mechanical watches depends on the stability of the natural frequency of the oscillator constituted by the balance and the balance spring. As the temperature varies, thermal expansion of the balance spring and the balance, as well as the variation in the Young's module of the balance spring, modify the natural frequency of said vibrating assembly, in so interfering with the accuracy of the watch.

Various solutions are familiar from the prior art, which attempt to reduce, or to suppress, the variations in the frequency of an oscillator with the temperature. One such approach considers that the natural frequency F of an oscillator depends on the relationship between the constant of the restoring torque C exerted by the balance spring on the balance and the moment of inertia I of the latter, as stated in the following relationship:

$$F=\sqrt{(C/1)}/2\pi$$

By deriving the preceding equation in relation to the temperature, we obtain the relative thermal variation in the natural frequency of the oscillator, which is expressed as:

$$(1/F)dF/dT=[(1/E)dE/dT+3\alpha_s-2\alpha_b]/2$$

Where E is Young's modulus of the balance spring, (1/F)dF/dT is the thermal coefficient of the oscillator, also designated simply by the acronym TC, (1/E)dE/dT is the thermal coefficient of the Young's modulus of the balance spring of the oscillator, also designated simply by the acronym TCY, $\alpha_s$ and $\alpha_b$ are respectively the coefficients of thermal expansion of the balance spring and of the balance of the oscillator.

Various solutions that are familiar from the prior art seek to nullify the value of the thermal coefficient TC of the oscillator by selecting a TCY for the balance spring that is adapted for this purpose. In the case of an anisotropic material, for example silicon, the thermal coefficient varies according to the crystalline direction of the stressing of the material and thus varies over the length of the balance spring. Similarly, in the case of a heterogeneous material, such as oxidized silicon, the thermal coefficient varies within the cross section of the strip. An equivalent or apparent TCY, which will be familiar to a person skilled in the art, is thus considered for the balance spring formed from an anisotropic and/or heterogeneous material. Solutions that are familiar from the prior art seek to nullify the value of the thermal coefficient TC of the oscillator by selecting an equivalent or apparent TCY for the balance spring that is adapted for this purpose.

In the following description, the expression "TCY" is intended in particular to denote "equivalent or apparent TCY".

By way of example, document EP1258786 proposes the use of a balance spring made of a particular paramagnetic Nb—Hf alloy containing an advantageous level of Hf. The selected alloy is relatively complicated to produce.

Document EP1422436 describes another solution based on a balance spring made of silicon comprising a layer of oxide. This solution calls for a layer of oxide having a high thickness. Its production requires the balance spring to be treated for a considerable time at a very high temperature, which is a disadvantage.

The object of the invention is to provide another solution for a spiral spring which permits the thermo-compensation of the oscillator, in order to obtain an oscillator of which the frequency is independent or quasi-independent of the temperature, and which does not exhibit all or some of the disadvantages associated with the prior art.

For this purpose, the invention relates to a balance spring for an oscillator for a timepiece, wherein it comprises a component part, in particular at least a coil or a portion of a coil, provided with heavily doped silicon having doping greater than or equal to $10^{18}$ at/cm$^3$, in order to permit the thermo-compensation of the oscillator.

Said component part, in particular said coil or said portion of a coil, may comprise a cross section varying locally over its length, in particular over the length of said coil or said portion of a coil. This variation may be a variation in thickness and/or in height.

As an alternative or in addition, said component part may comprise an external oxidized layer, in particular consisting of silicon dioxide $SiO_2$.

The invention is defined more precisely by the claims.

These objects, characterizing features and advantages of the present invention are disclosed in detail in the following description of particular embodiments that are given without limitation in conjunction with the accompanying figures, in which.

Figure 1:
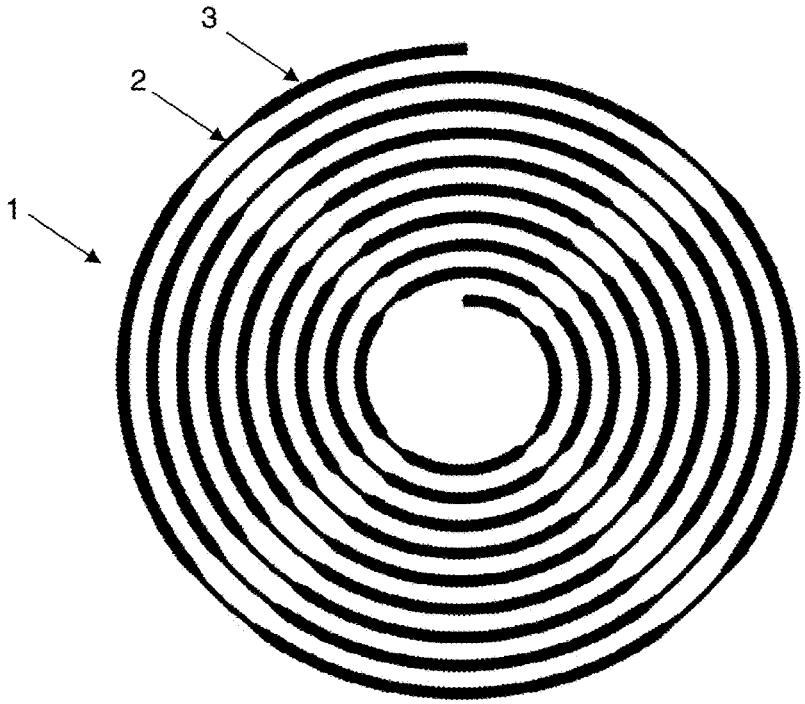
FIG. 1 depicts schematically a balance spring for a timepiece according to one embodiment of the invention.

According to one embodiment of the invention, an oscillator for a timepiece comprises a balance/balance spring assembly, the balance spring being present in the form of a flexible strip of rectangular cross section, wound around itself in the form of an Archimedes' spiral. The balance is made from a copper/beryllium alloy in a manner known per se. As a variant, other materials may be used for the balance. Similarly, the balance spring could exhibit a different basic geometry, such as a non-rectangular cross section.

The object of the invention is to propose a solution approaching as closely as possible to a zero value for the thermal coefficient (TC) for the balance/balance spring assembly, of which the swings thus become independent or quasi-independent of the temperature. For this purpose, it is necessary to combine the material of the balance spring with that of the balance in order to obtain a good result. By way of example, with a balance made of CuBe2, the balance spring must have a thermal coefficient of the Young's modulus (TCY) in the order of 26 ppm/° C. in order to thermo-compensate the oscillator.

According to an essential element of the invention, the balance spring of the embodiments is made of silicon and comprises at least one coil or portion of a coil made of heavily doped silicon. The expression heavily doped is understood here to denote that the silicon exhibits doping having an ion density greater than or equal to $10^{18}$ at/cm$^3$, or greater than or equal to $10^{19}$ at/cm$^3$, or greater than or equal to $10^{20}$ at/cm$^3$. Said doping of the silicon is obtained by means of elements providing one additional electron (type p doping, or "p-doped silicon") or one fewer electron (type n doping, or "n-doped silicon"). It has been established that, depending on the material used for the balance, for example titanium or an alloy of titanium, this heavily doped silicon alone may be sufficient to obtain thermo-compensation of the oscillator. By way of example, type n doping is obtained, for example, by using at least one element from among: antimony Sb, arsenic As, or phosphorus P. Type p doping is obtained, for example, by using boron B.

The component part made of heavily doped silicon advantageously occupies the entire length of the balance spring. In other words, all the coils made of a silicon of a balance spring may advantageously be heavily doped. According to one embodiment, the coil or the portion of a coil is heavily doped for its entire cross section. In other words, the component part made of heavily doped silicon occupies the entire cross section of a coil or a portion of a coil, that is to say that the doping is extensive. According to one variant embodiment, the component part made of heavily doped silicon occupies only a superficial layer of the cross section of a coil or a portion of a coil, in particular a wall of a coil or of a portion of a coil. Furthermore, in the embodiments that are to be described below, the doping is advantageously uniform over all the coils of the balance spring, or on the whole of the balance spring and/or on the whole of a cross section of the balance spring. As a variant, it may be non-uniform and variable according to the coils or the portions of the coils and/or according to the cross section of the coils or the portions of the coils of the balance spring.

It has also been noted, however, that the thermo-compensation is dependent on the crystal orientation. In other words, the effect of doping the silicon of the balance spring imparts an anisotropic thermo-compensation characteristic.

Thus, according to an advantageous embodiment, the geometry of the spiral spring exhibits variations in cross section over its length in order to take account of said anisotropy. In other words, the balance spring exhibits a variation in cross section depending on the crystallographic orientation of the heavily doped silicon.

A first embodiment is thus based on the modulation of the thickness of the coils of the balance spring, that is to say a variation in the dimension of the side of the coils situated in a plane parallel to the plane of the balance spring, and more particularly a variation in the dimension of the coils that is locally perpendicular to the neutral fiber of the balance spring in a plane parallel to the plane of the balance spring. Said modulation of the thickness is selected in order to facilitate the flexing of first zones of the balance spring. Said first zones of the balance spring exhibit a local TCY that is greater than the local TCY of second zones of the balance spring. The modulation of the thickness of the coils, more particularly the reduction of the thickness of the coils in said first zones of the balance spring, thus makes it possible to optimize the thermo-compensation of the oscillator. As a general comment, said modulation of the thickness impacts on the regularity of the rigidity of the strip, and accordingly on the mechanical performance at a constant temperature. However, this effect is considered as being limited in relation to the effect of the variations in the TCY of the balance spring with the temperature. Furthermore, it is possible to compensate for this effect by means of related variations in the cross section of the coils of the balance spring.

Figure 2:
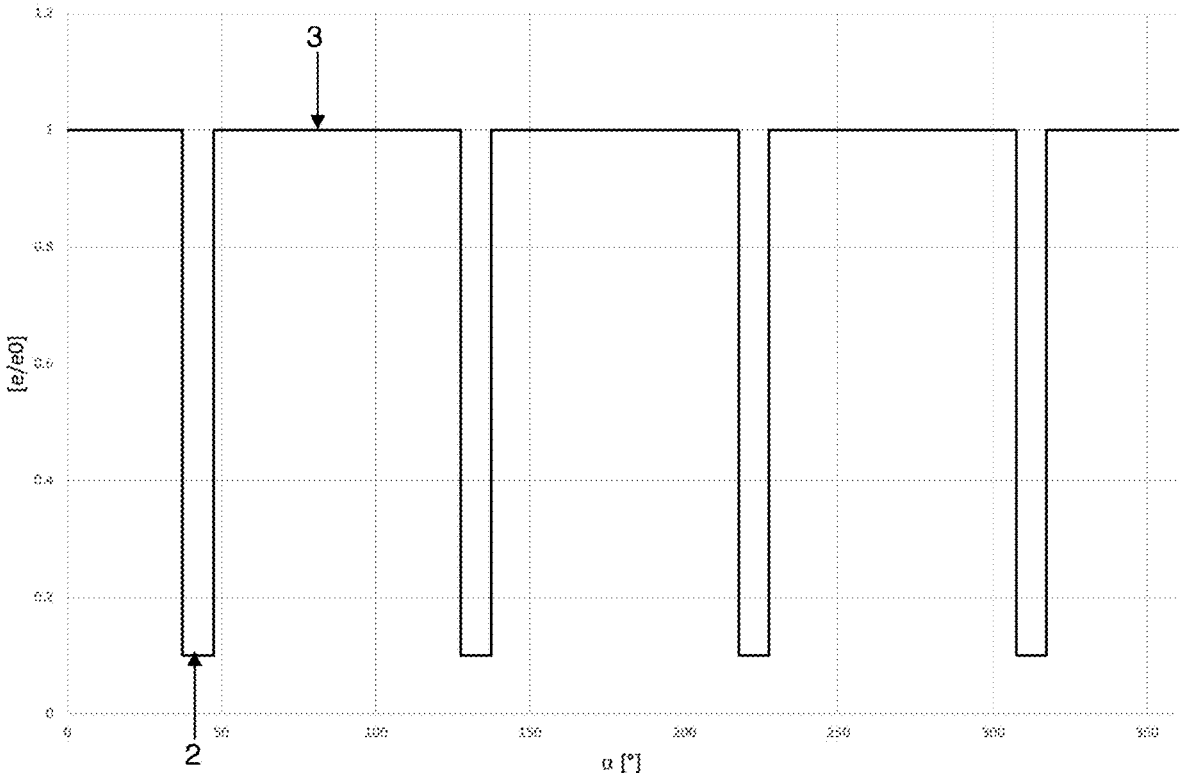
FIG. 2 depicts the evolution of the relative thickness of the balance spring depending on its angle defined on the basis of its point of attachment according to the embodiment of the invention.

FIG. 1 thus depicts a balance spring 1 of constant pitch in equilibrium or at rest according to one embodiment of the invention, constituted by nine turns, and comprising a change in the thickness of the coils exhibited by the curve depicted in FIG. 2. Said FIG. 2 shows the relative change in the thickness (e/e0) of the coils depending on the angle ($\alpha$), at a reference point in polar coordinates and centered on the center of the balance spring. It appears that each coil exhibits reductions in thickness 2 in zones extending in a given angular range, said angular range varying according to the doping of the silicon of the balance spring and according to any oxidation of the heavily doped balance spring. Said angular range may lie between 2 and 80 degrees, in particular between 5 and 40 degrees, and in particular between 5 and 20 degrees. In our particular embodiment, the plane of the balance spring coincides substantially with a plane {011} of the monocrystalline silicon. In this particular embodiment, the first zones of the balance spring, in particular the reductions in thickness 2, coincide substantially with the locations in which the tangent to the neutral fiber is aligned with a direction <100> of the monocrystalline silicon. In this particular embodiment, the reductions in thickness 2 are disposed periodically along the coils of the balance spring with a period of 90°. In an alternative embodiment, in which the plane of the balance spring does not coincide substantially with a plane {001} of the monocrystalline silicon, the reductions in thickness may be disposed periodically along the coils of the balance spring with a period of 180 degrees. Outside the reductions in thickness, the thickness may or may not remain substantially constant. It should be noted that the reductions in thickness, that is to say the local variations in the dimension of the coils, may or may not be equal. The geometries of the reductions in thickness may or may not differ. Thus, reductions in thickness are disposed periodically with a given period, even though the local variations in the dimension of the coils or the geometries of the reductions in thickness may differ. It should be noted that, with such a geometry, the balance spring may exhibit any thickness and any pitch, while maintaining a good thermal performance, which makes it possible to determine these parameters depending on criteria that are set by the search for the best chronometric performance of the oscillator.

Figure 3:
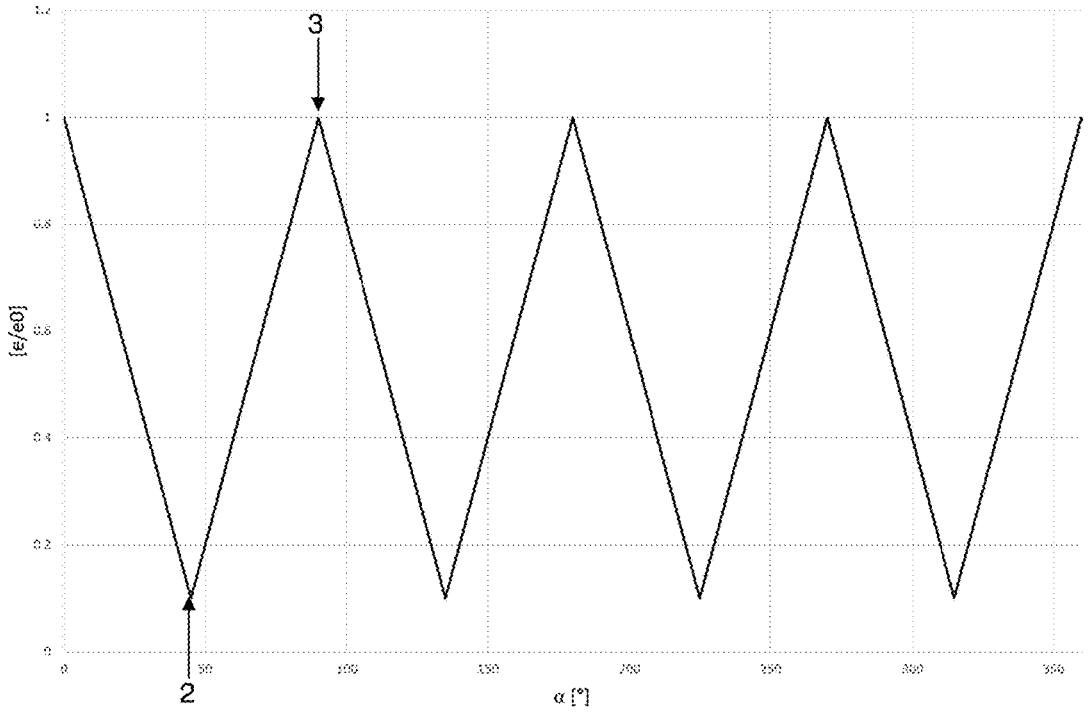
FIG. 3 depicts the evolution of the relative thickness of the balance spring depending on its angle defined on the basis of its point of attachment according to a variant of the embodiment of the invention.

FIG. 3 depicts as a variant a periodic development in the relative thickness (e/e0) of the coils which exhibit a linear profile, over 45 degrees. Thus, in this particular variant, each coil exhibits a minimum thickness 2 for the angles 45, 135, 225 and 315 degrees, and maximum thicknesses 3 for the angles 0, 90, 180 and 270 degrees. The angle of 0 degrees corresponds to the lower extremity of the balance spring. Between these extreme thicknesses 2, 3, the balance spring exhibits a thickness which varies in a linear fashion with the angle. In this embodiment, the development in the thickness is accordingly periodic and similar on each coil.

In these two embodiments, the reduction in the thickness may range from 5 to 90% in relation to the maximum thickness, and in particular from 10 to 40% in relation to the maximum thickness.

According to a variant embodiment, the variation in the cross section of the coils of the balance spring may be achievable by a modification in the height of the coils, that is to say in the dimension perpendicular to the plane of the balance spring. This modification may be obtained, for example, by grey photolithography, with the same aim of facilitating the flexing of the first zones of the balance spring in this way.

Naturally, other embodiments can be envisaged, based on the variation in the form and/or in the dimensions of the cross section of the coils. For example, it is possible to vary the thickness and the height of the coils, by combining the two embodiments described previously. The modification of the geometry has as its object to facilitate the flexing of the balance spring in the favorable zones, in particular with a positive thermal coefficient. Advantageously, said variation in the cross section of the balance spring depending on the angle, at a reference point in polar coordinates, is periodic. In particular, this period may be between 90 and 180 degrees. Furthermore, this variation in cross section with the aim of optimizing the thermal performance of the balance spring may be combined with an additional variation in the cross section, which is in general not periodic, adapted to the optimization of the chronometric performance of the balance spring.

As a general comment, the zones of the balance spring to be enhanced may be determined by a theoretical calculation and/or in an empirical fashion.

It can be established, furthermore, that heavier doping imparts a greater thermo-compensation effect. It may also be possible to provide heavier doping in certain zones of the balance spring, in particular the aforementioned favorable zones. It is also possible, as a variant or in addition, to provide heavier doping in the zones that are closest to the surface of the balance spring.

This variation in the doping may be undertaken retrospectively by ion diffusion or ion implantation, in order to obtain a "fine" adjustment of the TCY of the balance spring after its production. Naturally, the different variations described in the preceding embodiments may be combined.

It has been established that the variation in the cross section of a balance spring alone makes it possible to obtain good results by using a very heavily doped silicon. It can be noted that light oxidation of the silicon, over and above the characterizing features described in the preceding embodiments, makes it possible to obtain an equivalent result with a silicon that has been doped slightly less heavily. In other words, oxidation of the heavily doped silicon makes it possible to improve the performance in terms of thermo-compensation with equivalent silicon doping, or to reduce the extent of the modulation of the thickness of the coils.

Figure 4:
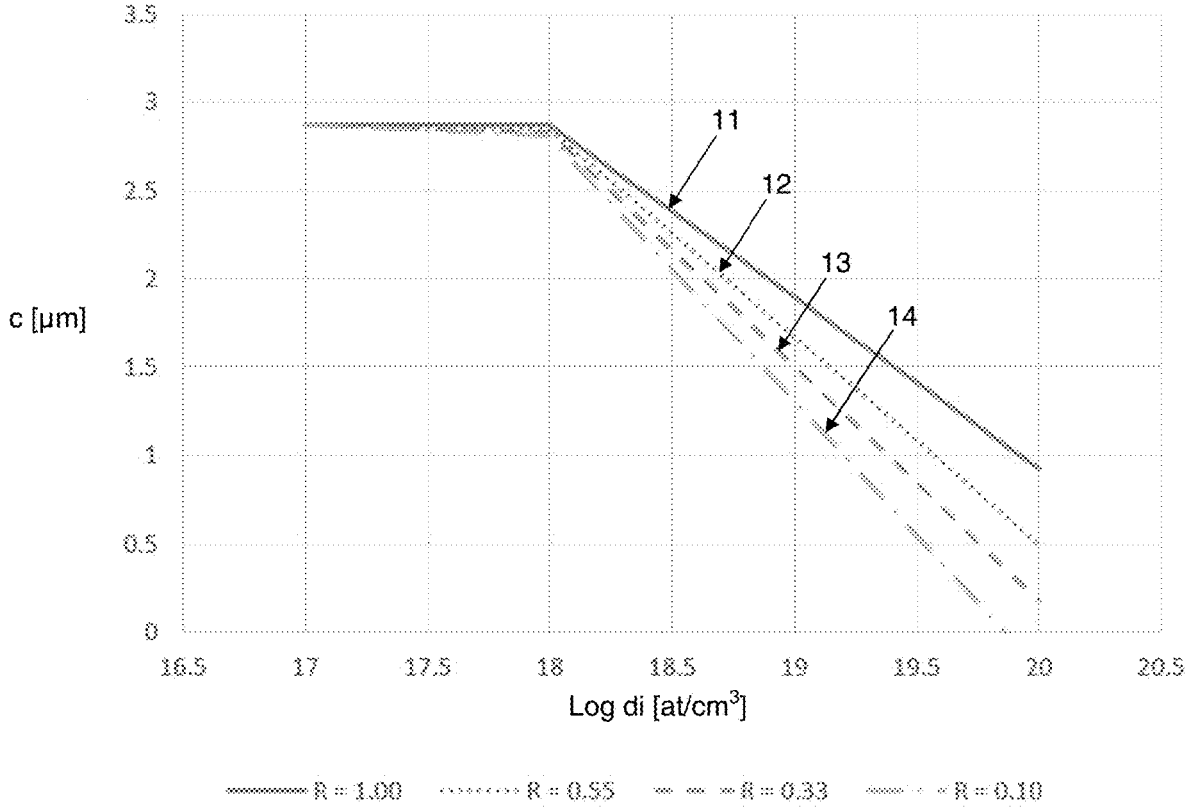
FIG. 4 depicts the thickness of the oxide layer of a balance spring, of which the variations in cross section are consistent with those of the balance spring depicted in FIG. 3 for different ratios of the minimum thickness to the maximum thickness depending on the density of its doping, in order to produce variants of the embodiment of the invention.

FIG. 4 illustrates this effect. The four straight lines 11, 12, 13, 14 respectively represent four balance springs, each exhibiting a different variation in cross section obtained by the periodic modulation of the cross section of the balance spring, of which the relationship R between the minimum thickness and the maximum thickness of the coils is 1, 0.55, 0.33 and 0.10 respectively. These four balance springs are associated with the same balance made of CuBe2 in order to form oscillators. For each of these balance springs, the thickness of the oxide (c) necessary in order to achieve a zero thermal coefficient is represented as a function of the logarithm for the ion density (log di). It can be noted in all these cases that doping with an ion density of up to $10^{18}$ at/cm$^{-3}$ requires a layer of oxide in the order of 3 μm. It can be noted in all cases that very high doping with an ion density greater than $10^{18}$ at·cm$^{-3}$ requires a thinner layer of oxide, or no layer of oxide. Furthermore, the layer of oxide may be nullified advantageously for a balance formed from a material of which the coefficient of thermal expansion is substantially lower. As a general comment, embodiments having layers of oxide of smaller thickness, or even zero thickness, continue to be interesting and are covered by the present invention, even if the thermal coefficient is slightly less good, which is compensated for by the greater simplicity of manufacture. In addition, it can be noted that, the less pronounced the modulation of the thickness of the balance spring (larger relationship R), the heavier the doping of silicon required in order to obtain a zero thermal coefficient without oxidation. As a general comment, it has also been noted that these curves remain substantially unchanged if only the type of modulation of the thickness is modified, for example according to FIGS. 2 and 3, while retaining an identical relationship R.

It can be seen, therefore, that the invention also relates to a balance spring comprising a component part made of heavily doped silicon and comprising an external layer of oxidation. In particular, embodiments are obtained by adding a layer of oxide to the previously described embodiments. In all cases, by considering more generally any balance spring of a timepiece according to any embodiment, the oxide layer exhibits a small thickness, its maximum thickness being less than or equal to 5 μm, or less than or equal to 3 μm, or less than or equal to 2.5 μm, or less than or equal to 2 μm, or less than or equal to 1.5 μm.

The invention also relates to a method for producing a balance spring as described previously. Said method comprises in particular a step involving cutting the balance spring in a wafer made of heavily doped silicon, for example by the deep reactive ion etching method (in English: Deep Reactive Ion Etching, DRIE), said cutting being such as to permit the formation of a variable cross section of the coils making up the balance spring. More specifically, according to one embodiment, said cutting makes it possible to form coils of variable thickness by the selection of the form on the mask. Another embodiment consists of forming coils having a variable height, for example with the help of grey photolithography, whereby multiple etchings utilize different masks, or other methods that are familiar to a person skilled in the art.

As a general comment, the wafer may be produced from an ingot of heavily doped silicon, which has itself been obtained by a step involving the heavy doping of the silicon in the course of its growth.

As a variant, the method of production comprises a step involving cutting the balance spring in a silicon wafer, followed by a step involving doping of the silicon after cutting, in particular by ion diffusion or ion implantation, in order to obtain a balance spring comprising very highly doped silicon. In this embodiment, a step of (supplementary) doping is thus added after cutting. The silicon wafer may or may not be heavily doped initially. This embodiment makes it possible to dope more heavily those zones that are close to the surface and are more highly stressed in the course of the deformations under vibration. As a general comment, resorting to retrospective doping offers the advantage of making it possible to obtain a higher rate of doping and, in so doing, to avoid recourse to oxidation of the silicon, or to reducing the necessary layer of oxide.

This method of production also offers the advantage of benefiting from the flexibility of cutting in a wafer made of silicon, which makes it possible to achieve highly diverse geometries, and in particular to vary the thickness of the strip forming a coil of the balance spring with very few limitations.

The wafer may preferably be made of monocrystalline silicon oriented in the direction <100>.

According to one variant embodiment, the method of production comprises an additional step of oxidation. As explained previously, the layer of oxidation that is used has a small thickness, in all the embodiments, which offers the advantage of permitting its production at a low oxidation temperature, and of thereby avoiding the premature wear of the furnace that is used. In addition, this small thickness of the layer of oxidation also permits its production by the use of oxygen as a precursor, instead of the water vapor that is used for thicker layers of oxidation, thereby making it possible to form a layer of oxidation of high quality while minimizing its growth time.

The invention also relates to an oscillator of a timepiece, a movement of a timepiece and a timepiece, such as a watch, for example a wristwatch, comprising a balance spring of the kind described previously.

The invention claimed is:

1. A balance spring for an oscillator of a timepiece, comprising:

a component part that is a coil or a portion of the coil provided with heavily doped silicon, wherein the component part includes a cross section varying locally over a length of the component part, and the variation in the cross section is implemented by a reduction in at least one of a thickness and a height of the component part of the balance spring in first zones, wherein the first zones of the component part of the balance spring coincide with places where a tangent to a neutral fiber is substantially in alignment with a direction <100> of a monocrystal constituting the balance spring, and wherein the heavily doped silicon has an ion density greater than or equal to $10^{18}$ at/cm$^3$, in order to permit thermo-compensation of the oscillator.

2. The balance spring for an oscillator of a timepiece as claimed in claim 1, wherein the component part comprises heavily doped silicon having an ion density greater than or equal to $10^{19}$ at/cm$^3$.

3. The balance spring for an oscillator of a timepiece as claimed in claim 1, wherein the variation in cross section is periodic.

4. The balance spring for an oscillator of a timepiece as claimed in claim 1, wherein, within the first zones, minimum values of the at least one of the thickness and the height of the component part of the balance spring coincide with places where a tangent to a neutral fiber is substantially in alignment with the direction <100> of the monocrystal constituting the balance spring.

5. The method for producing the balance spring as claimed in claim 4, wherein the method comprises:

an action involving the heavy doping of the silicon, and an action involving production of a wafer made of the heavily doped silicon, followed by an action involving cutting the wafer in order to obtain the balance spring consisting of the heavily doped silicon.

6. The method for producing the balance spring as claimed in claim 5, wherein the method comprises implementing the variation in cross section by a variation in thickness.

7. The balance spring for an oscillator of a timepiece as claimed in claim 1, wherein the component part consists of heavily doped silicon for at least one of a whole of a thickness and a whole of a height of the component part, or of a layer of a surface of the component part.

8. The balance spring for an oscillator of a timepiece as claimed in claim 1, comprising an external oxidized layer.

9. The balance spring for an oscillator of a timepiece as claimed in claim 8, wherein the external oxidized layer has a thickness less than or equal to 5 μm.

10. The balance spring for an oscillator of a timepiece as claimed in claim 8, comprising, over an entire length of the balance spring, a variable cross section consisting of heavily doped silicon having doping greater than or equal to $10^{18}$ at/cm$^3$ and comprising the external oxidized layer.

11. The balance spring for an oscillator of a timepiece as claimed in claim 1, wherein the component part made of heavily doped silicon is of a nature so as to substantially nullify the expression:

$$TCY+3\alpha_s-2\alpha_b$$

where

TCY is a thermal coefficient of Young's modulus, $\alpha_s$ is a coefficient of thermal expansion of the balance spring, and $\alpha_b$ is a coefficient of thermal expansion of a balance intended to interact with the balance spring.

12. An oscillator for a timepiece, wherein the oscillator comprises the balance spring as claimed in claim 1.

13. A timepiece, wherein the timepiece comprises the balance spring as claimed in claim 1.

14. The method for producing the balance spring as claimed in claim 1, wherein the method comprises cutting a wafer made of the silicon in order to form the balance spring, followed by performing the heavy doping of the silicon after cutting, in order to obtain the balance spring consisting of the heavily doped silicon.

15. A method for producing the balance spring as claimed in claim 1, wherein the method comprises:

an action involving the heavy doping of the silicon, and an action involving production of a wafer made of the heavily doped silicon, followed by an action involving cutting the wafer in order to obtain the balance spring consisting of the heavily doped silicon.

16. The method for producing a balance spring as claimed in claim 15, wherein the method comprises all or part of at least one of the following actions:

cutting the balance spring so as to form a modulation of a thickness of the balance spring; and second cutting of the balance spring in order to form a variation in a height of at least one coil of the balance spring.

17. The method for producing the balance spring as claimed in claim 15, wherein the method comprises performing oxidation of at least one part of the silicon of the balance spring.

18. The balance spring for an oscillator of a timepiece as claimed in claim 1, wherein the component part comprises heavily doped silicon having an ion density greater than or equal to $10^{20}$ at/cm$^3$.

19. The balance spring for an oscillator of a timepiece as claimed in claim 1, wherein the variation in cross section is implemented by a variation in thickness.

20. The balance spring for an oscillator of a timepiece as claimed in claim 1, wherein the first zones of the component part of the balance spring exhibit reductions in thickness extending in an angular range lying between 5 and 20 degrees.

* * * * *